US008587227B2

(12) United States Patent
Koch

(10) Patent No.: US 8,587,227 B2
(45) Date of Patent: Nov. 19, 2013

(54) ELECTROSTATIC ION ACCELERATOR ARRANGEMENT

(75) Inventor: Norbert Koch, Ulm (DE)

(73) Assignee: Thales Electronic Systems GmbH, Ulm (DE)

( * ) Notice: Subject to any disclaimer, the term of this patent is extended or adjusted under 35 U.S.C. 154(b) by 286 days.

(21) Appl. No.: 12/733,624

(22) PCT Filed: Sep. 12, 2008

(86) PCT No.: PCT/EP2008/062169

§ 371 (c)(1),
(2), (4) Date: May 28, 2010

(87) PCT Pub. No.: WO2009/037200

PCT Pub. Date: Mar. 26, 2009

(65) Prior Publication Data

US 2010/0289437 A1 Nov. 18, 2010

(30) Foreign Application Priority Data

Sep. 14, 2007 (DE) ..... 10 2007 044 074

(51) Int. Cl.
*H05H 7/00* (2006.01)

(52) U.S. Cl.
USPC ..... 315/506; 313/359.1

(58) Field of Classification Search
USPC ..... 315/500, 506; 313/359.1, 362.1
See application file for complete search history.

(56) References Cited

U.S. PATENT DOCUMENTS

| | | | | |
|---|---|---|---|---|
| 3,159,967 | A | | 12/1964 | Webb |
| 4,577,461 | A | | 3/1986 | Cann |
| 4,825,646 | A | * | 5/1989 | Challoner et al. ..... 60/202 |
| RE34,575 | E | * | 4/1994 | Klinkowstein et al. .... 313/359.1 |
| 5,581,155 | A | | 12/1996 | Morozov et al. |
| 5,646,476 | A | * | 7/1997 | Aston ..... 313/359.1 |
| 5,945,781 | A | | 8/1999 | Valentian |
| 6,391,164 | B1 | | 5/2002 | Beilis et al. |
| 7,084,572 | B2 | * | 8/2006 | Kornfeld et al. ..... 315/111.21 |
| 7,098,614 | B2 | * | 8/2006 | Yamashita ..... 315/500 |
| 2004/0183452 | A1 | | 9/2004 | Kornfeld et al. |

FOREIGN PATENT DOCUMENTS

WO WO 03/000550 1/2003

* cited by examiner

*Primary Examiner* — Thuy Vinh Tran
(74) *Attorney, Agent, or Firm* — Collard & Roe, P.C.

(57) ABSTRACT

An arrangement with radiation cooling of the anode, which avoids the need for complex additional cooling measures, is proposed for an electrostatic ion accelerator arrangement in which the thermal power loss which is not negligible occurs at the anode, which is arranged in an ionization chamber, during operation.

11 Claims, 1 Drawing Sheet

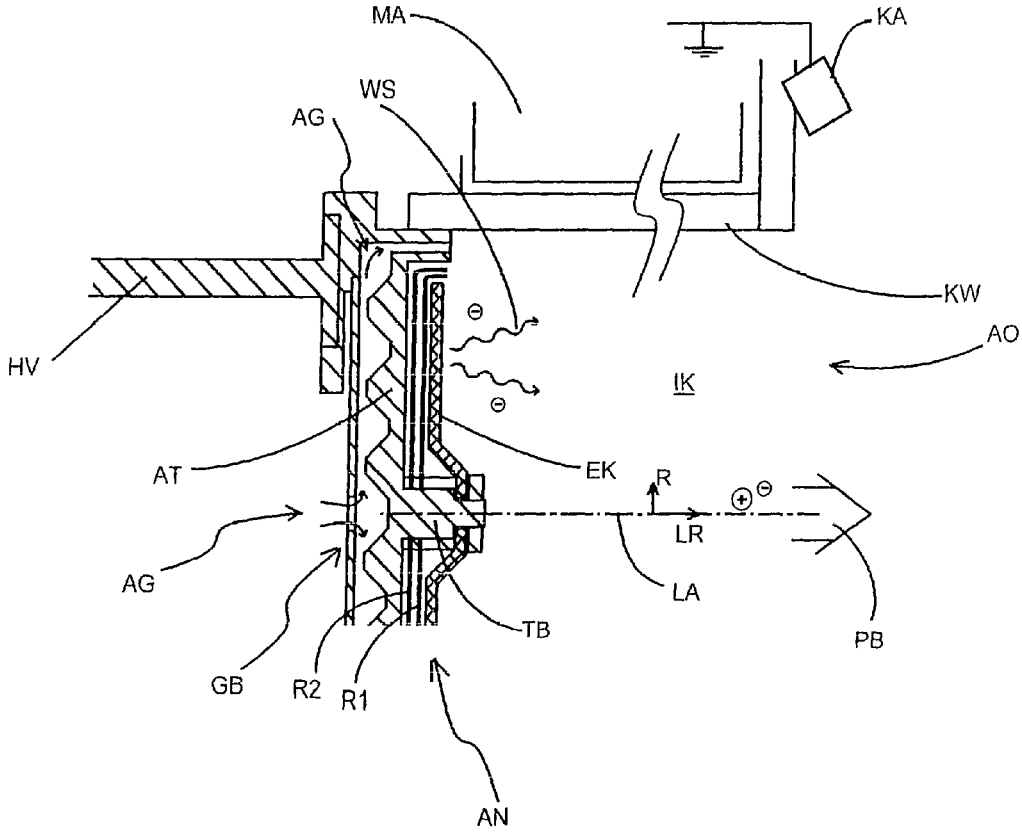
MA
KA
WS
AG
KW
HV
AO
IK
AT
EK
R
LR
AG
LA
TB
PB
GB
R2
R1
AN

ELECTROSTATIC ION ACCELERATOR ARRANGEMENT

CROSS REFERENCE TO RELATED APPLICATIONS

This application is the National Stage of PCT/EP2008/062169 filed on Sep. 12, 2008, which claims priority under 35 U.S.C. §119 of German Application No. 10 2007 044 074.1 filed on Sep. 14, 2007. The international application under PCT article 21(2) was not published in English.

The invention relates to an electrostatic ion accelerator arrangement.

Electrostatic ion accelerator arrangements can advantageously be used as drive devices in spacecraft. An advantageous embodiment known from WO 2003/000550 A1 provides for a structure having a circular-cylindrical ionization chamber, the center longitudinal axis of which determines a longitudinal direction of the chamber geometry. In another embodiment of ion accelerators as so-called Hall thrusters, the chamber is configured in ring shape around a central inner part. The ionization chamber has a beam exit opening on one side, in the longitudinal direction, by means of which a plasma beam is initiated in the longitudinal direction. A cathode is disposed outside of the ionization chamber, offset laterally relative to the beam exit opening. An anode is disposed at the foot of the ionization chamber, set opposite the beam exit opening in the longitudinal direction. A high voltage between anode and cathode forms an electrostatic field in the ionization chamber that points in the longitudinal direction and accelerates ions of a working gas ionized in the ionization chamber in the direction of the beam exit opening and electrons in the direction of the anode. A magnetic field that passes through the chamber brings about a long dwell time of electrons in the chamber before they are absorbed by the anode. The residual energy of the electrons when they impact the anode and the current through the anode bring about the formation of lost heat in the anode, so that the latter heats up, thereby limiting the drive power, under some circumstances, and/or making complicated and possibly problem-prone cooling by means of solid body heat conduction and/or fluid cooling necessary.

The invention is based on the task of indicating an electrostatic ion accelerator arrangement that manages high lost heat at the anode while having a simple structure.

The invention is described in the independent claim. The dependent claims contain advantageous embodiments and further developments of the invention.

By means of giving off the lost heat that primarily occurs in the anode from the energy of the electrons that impact on the anode predominantly (greater than 50%) in the form of heat radiation in the direction of the ionization chamber, in other words into the half-chamber in front of the anode arrangement that faces the beam exit opening, a particularly simple structure of the anode arrangement is obtained, in which a proportion of the lost heat power that occurs in the anode and particularly flows away by way of metallic or non-metallic components, by means of solid body heat conduction, amounts to less than 50% of the total heat loss power that occurs in the anode at maximal power of the ion accelerator arrangement. Another, although lower contribution to conducting away lost heat from the anode is advantageously made by feeding in the cold, neutral working gas, to flow around the anode arrangement, whereby the working gas absorbs heat from the anode arrangement and transports it into the ionization chamber. It is advantageous, in this connection, that a higher lost heat power corresponds to stronger flow cooling at an increasing gas stream. The main proportion of the lost heat that occurs in the anode, however, is radiated off in the direction of the ionization chamber, as heat radiation.

It is advantageous if the surface of the anode arrangement that faces the ionization chamber reaches a temperature of at least 500° C. at a working point of the ion accelerator arrangement with maximally occurring lost heat power. In this connection, advantage is advantageously taken of the fact that the power given off by a body as heat radiation increases disproportionately (with the $4^{th}$ power) to the temperature.

The surface of the anode arrangement that faces the ionization chamber is advantageously oriented essentially perpendicular to the longitudinal axis of the ionization chamber, so that the radiation proportion of the emission that points in the direction of the surface normal line points in the direction of the beam exit opening, and the heat radiation emitted in this direction is directly given off to the surrounding free space.

By means of the placement of a heat radiation reflector device on the side of the anode electrode, which electrode faces the ionization chamber, but which side faces away from the ionization chamber, the heat radiation is increasingly directed into the ionization chamber and toward the beam exit opening. In a first embodiment, the reflector device can comprise a reflective coating of a back surface of the anode electrode, which surfaces face away from the ionization chamber. In this connection, the emission capacity of the front surface that faces the ionization chamber, in the direction of the beam exit opening, is greater than, particularly at least twice as great as the emission capacity of the coated back surface of the anode electrode, with reference to the maximal spectrum of the heat radiation emitted by the front surface, in each instance.

It is advantageous if the reflector device contains at least one reflector surface that is spaced apart from the anode electrode in the longitudinal direction and disposed on the side of the anode electrode that faces away from the ionization chamber, which surface is configured to reflect heat radiation. In this connection, the emission capacity of the front surface of the anode electrode, which faces the ionization chamber, is greater than, particularly at least twice as great as the emission capacity of the reflector surface of the reflector device that faces the anode electrode. Preferably, at least two reflector surfaces that are spaced apart from one another in the longitudinal direction are provided. The reflector surfaces are preferably metallic and advantageously lie on the potential of the anode electrode, and can particularly be combined with the latter structurally, in a multi-part anode arrangement.

In yet another embodiment, the anode can be composed of a carrier, particularly a metallic carrier, and an electrode material that stands in direct physical contact with it, facing the ionization chamber, whereby the carrier can be pot-shaped, for example, and the emission capacity of the back of the carrier, which faces away from the ionization chamber, is smaller, particularly less than half as great as that of the front of the electrode material, which faces the ionization chamber.

It is particularly advantageous to use graphite as the electrode material for the anode electrode, particularly for the surface of the anode electrode that faces the ionization chamber. Preferably, the anode electrode is formed by a disk-shaped body that can particularly be structured as a material-homogeneous graphite body. Graphite retains its shape up to high temperatures, and demonstrates lower electrical resistance and, in particular, a negative temperature coefficient of electrical resistance. The surface of graphite demonstrates particularly good emission behavior. A coating of the back surface as a reflector device can be provided by means of a vapor-deposited metal layer.

The disk-shaped body of the anode electrode advantageously takes up the predominant cross-sectional area proportion of the chamber cross-section, at an essentially uniform temperature of the area. It is advantageous if the disk-shaped body is connected with, particularly screwed onto the carrier body of the anode arrangement at only one attachment point, centrally, in the region of its center. The attachment structure advantageously consists of a highly heat-resistant material, particularly molybdenum. The heat power proportion that flows onto a carrier body, by way of the attachment of the electrode body within the anode arrangement, and the heat power proportion that reaches the carrier body by way of the reflector device, as residual radiation, can be carried off by way of existing structures, such as the suspension of the carrier body in the structure of the chamber and/or the metallic high-voltage feed line, without special active cooling measures, by means of solid body heat conduction.

The invention will be illustrated in greater detail in the following, using a preferred example and making reference to the drawing:

The drawing shows, schematically and in details, an electrostatic ion accelerator arrangement having an anode arrangement. An ionization chamber IK of the ion accelerator arrangement shall be assumed to be rotation-symmetrical about a center longitudinal axis LA, without any restriction in generality. The center longitudinal axis LA runs parallel to a longitudinal direction LR. A radial direction R is also shown. The circular cross-section of the ionization chamber shall be essentially constant in the longitudinal direction LR. The ionization chamber demonstrates a beam exit opening AO, in the longitudinal direction LR, on one side, to the right in the drawing, from which opening an accelerated, directed plasma stream PB is discharged. In the region of the beam exit opening AO and preferably offset laterally relative to it, a cathode arrangement KA is disposed. Opposite the beam exit opening AO in the longitudinal direction, at the foot of the ionization chamber, there is an anode arrangement AN. In the drawing, because of the assumed rotation symmetry about the longitudinal axis LA, only the part of the ion accelerator arrangement that lies above the longitudinal axis LA is shown.

Between the cathode arrangement KA, which typically lies at mass potential M of the spacecraft, and the anode arrangement AN, particularly an anode electrode EK that faces the ionization chamber, a high voltage HV is applied, which generates an electrical field that points in the longitudinal direction in the ionization chamber. This electrical field accelerates electrons in the direction of the anode arrangement, and positively charged ions in the ionization chamber, generated by means of ionization of a working gas, in the direction of the beam exit opening AO. The ionization chamber is delimited, crosswise to the longitudinal axis LA, by means of a chamber wall KW, preferably composed of dielectrical material, particularly ceramic material. On the side of the chamber wall that lies radially on the outside with reference to the longitudinal axis, a magnet arrangement MA is disposed, the various possible superstructures of which are fundamentally known from the state of the art and which is therefore indicated only schematically, without any details. The magnet arrangement generates a magnetic field in the ionization chamber, which increases the dwell time of the electrons in the ionization chamber, whereby these give off energy to the working gas, by means of ionizing bursts, before they reach the anode electrode EK. Methods of action of such ion accelerators in different design versions, particularly also with a ring-shaped chamber geometry such as in Hall ion accelerators, are known from the state of the art.

Electrons that impact the anode electrode EK from the ionization chamber bring about the formation of lost heat in the anode electrode and cause it to heat up.

In the preferred example that is sketched, the anode arrangement AN contains, in the direction of the longitudinal axis LA, starting from the ionization chamber IK and proceeding to the left, an anode electrode EK, a first reflector surface R1, a second reflector surface R2, and an anode carrier body AT. The multiple components of the anode arrangement are mechanically connected with one another by way of a carrier structure that extends from the carrier body AT in the direction of the anode electrode EK, as a carrier bolt TB, for example. The multiple components are preferably all electrically conductive and lie at a common electrical potential, corresponding to an anode voltage HV, which is connected, for example, by way of the carrier body AT. For the mechanical connection of the multiple components, together with one another, with the anode arrangement AN, the carrier bolt TB can advantageously have a thread at its end that faces the ionization chamber, onto which thread a nut is screwed and secured. The relative position of the individual components of the anode arrangement AN in the direction of the longitudinal axis LA can be precisely set by way of spacer sleeves.

The anode electrode EK is advantageously formed by a material-homogeneous graphite body. The reflector surfaces R1 and R2 are preferably formed from a highly temperature-resistant metal, for example molybdenum, as essentially disk-shaped sheet-metal bodies. The carrier body AT and the carrier bolt TB, which is preferably formed in one piece with it, advantageously also consist of a highly temperature-resistant material such as, in particular, molybdenum. In the direction of the longitudinal axis on the side of the carrier body AT that faces away from the ionization chamber IK, a feed line for a working gas AG by way of an aperture GB is sketched, by way of which the working gas AG is fed in toward the carrier body AT in the surroundings of the longitudinal axis, in the axial direction, and passed along its surface that faces away from the ionization chamber IK, radially to the outside, and in the longitudinal direction LR, in the direction of the ionization chamber, in the region of the chamber wall KW. Preferably, a part of the reflector arrangement is also provided between the edge of the anode electrode EK that lies radially on the outside and the chamber wall, which part can be formed, for example, by means of edge sections that are angled away in the longitudinal direction LR, from the disk plane of one or both reflector devices R1, R2. In this way, radial emission of heat from the anode electrode EK in the direction of the chamber wall is reduced, for one thing, and for another, the working gas is prevented from flowing onto the anode electrode EK, and thus cooling of the anode electrode EK in the edge region is prevented.

If the anode electrode EK is heated up during operation of the ion accelerator arrangement, particularly due to the residual energy of the electrons that impact the anode electrode EK, then this electrode will increasingly emit heat radiation WS in the direction of the ionization chamber IK with an increasing temperature. The maximum of the emission characteristics of the surface of the anode electrode EK that faces the ionization chamber IK runs in the direction of the surface normal line, so that the maximum of the emission characteristics is directed in the direction of the beam exit opening AO in the case of an essentially planar embodiment of the disk-shaped anode electrode EK, and the heat radiation WS emitted in this direction is emitted directly into free space. By means of using graphite as the material of the anode electrode EK, the emission of heat radiation WS is particularly effective.

In the same manner, the anode electrode EK emits heat radiation at its back, in the direction facing away from the ionization chamber IK, toward the reflector device R1. By means of the reflector surface R1, which is configured to be heat-reflective, whose emission capacity is smaller than, particularly at most half as great as the emission capacity of the front surface of the anode electrode, however, a major portion of this heat radiation is radiated back to the anode electrode EK, so that the heat radiation proportion that is effectively emitted in the direction away from the ionization chamber IK remains small. This effect is reinforced by the second reflector surface R2, which in turn extensively reflects the heat radiation power emitted in the direction of the reflector surface R2 by the reflector surface R1, at low emission capacity, when this surface is heated up. Finally, the heat power emitted by the reflector surface R2 in the direction of the carrier body TK therefore remains low. A heat power that reaches the carrier body TK as the result of this remaining heat radiation power, as well as by means of solid body heat conduction by way of the carrier bolt TB, is predominantly conducted away by means of solid body heat conduction, by way of the metallic high-voltage feed line and the typically non-metallic structure that carries the anode arrangement. In addition, a small heat power proportion can be conducted away again by means of the working gas that flows along radially to the outside on the back of the carrier body.

The heat radiation not emitted into free space from the front surface of the anode electrode EK that faces the ionization chamber IK, directly through the beam exit opening AO, impacts the chamber wall KW and there is partly emitted into the ionization chamber and finally, into free space through the beam exit opening AO, or partly absorbed by the chamber wall, and, by means of heating up this wall, again given off to the ionization chamber as heat radiation, and into free space through the beam exit opening AO.

The anode electrode EK can advantageously reach temperatures of more than 500° C. at a maximal power dissipation that occurs, which typically occurs at a maximal drive power of the ion accelerator arrangement. The high temperature leads to a high intensity of heat radiation WS with an increase that is disproportional ($4^{th}$ power) to the temperature, so that an equilibrium state occurs. Despite the high temperature of the anode electrode EK, conducting away lost heat of the anode arrangement by way of a solid body heat line is less important, because of the great power of the heat radiation that is given off and its unilaterally preferred emission in the direction of the ionization chamber IK, and can be sufficiently managed by way of the metallic electrical connection for feeding in the anode high voltage and the suspension of the carrier body in the structure of the chamber. Active cooling by way of a fluid cooling circuit that conducts away a major portion of the lost heat is not necessary.

The characteristics indicated above and in the claims, as well as those that can be derived from the FIGURES, can advantageously be implemented both individually and in various combinations. The invention is not restricted to the exemplary embodiments described, but rather can be modified in many different ways, within the scope of the actions of a person skilled in the art.

The invention claimed is:

1. An electrostatic ion accelerator arrangement having an ionization chamber (IK), which has a beam exit opening on one side, in a longitudinal direction, with an anode arrangement (AN) and an electrode arrangement containing a cathode arrangement (KA), which generate an electrostatic field in the ionization chamber that essentially points in the longitudinal direction, whereby the anode arrangement is disposed opposite the exit opening, at a foot point of the chamber, and whereby lost heat occurs in an electrode body (EK) of the anode arrangement (AN), which absorbs electrons from the ionization chamber, wherein the anode arrangement gives off a predominant part of the lost heat that occurs in it to the ionization chamber (IK) as heat radiation (WS), and wherein the ionization chamber is adapted so that when working gas is introduced into the ionization chamber, the gas is ionized in the ionization chamber and gas ions are electrostatically accelerated and ejected through the exit opening of the ionization chamber, wherein a heat radiation reflector device (R1, R2) is disposed on the side of the electrode body (EK) that faces away from the ionization chamber (IK) and comprises a reflector surface having an emission capacity that is lower than the emission capacity of the front surface of the anode electrode that faces the ionization chamber.

2. The arrangement according to claim 1, wherein the reflector device contains at least one reflector surface (R1, R2) that is spaced apart from the electrode body in the longitudinal direction.

3. The arrangement according to claim 2, wherein the reflector surface laterally surrounds the electrode body (EK) crosswise to the longitudinal direction, with a continuation.

4. The arrangement according to claim 1, wherein the reflector device contains a coating of the side of the electrode body that faces away from the ionization chamber, as the reflector surface.

5. The arrangement according to claim 1, wherein the electrode body (EK) is configured essentially in disk shape.

6. The arrangement according to claim 1, wherein the electrode body is shielded with regard to the lateral delimitation of the ionization chamber, in heat-insulating manner.

7. The arrangement according to claim 1, wherein the electrode body is attached to a carrier body (AT, TB) at its center.

8. The arrangement according to claim 7, wherein a radial edge of the electrode body is radially spaced apart from other components.

9. The arrangement according to claim 1, wherein the working gas (AG) is fed to the anode arrangement from a side facing away from the ionization chamber.

10. The arrangement according to claim 1, wherein the working gas is guided radially outside of the electrode body (EK), past the latter, into the ionization chamber.

11. The arrangement according to claim 1, wherein the electrode body (EK) consists of graphite.

* * * * *

UNITED STATES PATENT AND TRADEMARK OFFICE

CERTIFICATE OF CORRECTION

PATENT NO. : 8,587,227 B2
APPLICATION NO. : 12/733624
DATED : November 19, 2013
INVENTOR(S) : Norbert Koch It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 434 days.

Signed and Sealed this
Twenty-second Day of September, 2015

Michelle K. Lee

Michelle K. Lee
*Director of the United States Patent and Trademark Office*